US006486486B1

(12) United States Patent
Haupenthal

(10) Patent No.: US 6,486,486 B1
(45) Date of Patent: Nov. 26, 2002

(54) FLAME MONITORING SYSTEM

(75) Inventor: Karl-Friedrich Haupenthal, Gaggenau (DE)

(73) Assignee: Siemens Building Technologies AG, Zug (CH)

( * ) Notice: Subject to any disclaimer, the term of this patent is extended or adjusted under 35 U.S.C. 154(b) by 0 days.

(21) Appl. No.: 09/375,866

(22) Filed: Aug. 17, 1999

(30) Foreign Application Priority Data

Sep. 10, 1998 (DE) ..... 198 41 475

(51) Int. Cl.[7] ..... G01J 31/14
(52) U.S. Cl. ..... 250/554
(58) Field of Search ..... 250/554, 342, 250/330, 227.23, 226; 340/578

(56) References Cited

U.S. PATENT DOCUMENTS 5,164,600 A * 11/1992 Das et al. ..... 250/554
5,495,112 A * 2/1996 Maloney et al. ..... 250/554
5,594,421 A * 1/1997 Thuillard ..... 340/578

* cited by examiner

*Primary Examiner*—Michael P. Stafira
(74) *Attorney, Agent, or Firm*—Proskauer Rose LLP

(57) ABSTRACT

The invention concerns a flame monitoring system and a method of monitoring a flame with a flame sensor (1) which converts the radiation emanating from the flame into a flame signal ($U_1$) and a flame signal amplifier (40) which converts the flame signal ($U_1$) into an output signal ($U_5$). A frequency-selective arrangement (6, 17, 18, 19) detects the presence of mains frequency-harmonic signals in the flame signal ($U_1$) and activates the flame signal amplifier (40) when there are no mains frequency-harmonic signals in the flame signal ($U_1$) and deactivates the flame signal amplifier (40) when there is a flame signal ($U_1$) with periodic signals or no flames signal ($U_1$) or a test signal (T). In that respect the frequency selective arrangement (6, 17, 18, 19) has a frequency detector (18) which detects the absence of mains frequency-harmonic flame signals ($U_1$) and appropriately activates or deactivates the flame signal amplifier (40) by way of switching means (6, 17, 18, 19). The frequency detector (18) integrates the flame signal ($U_1$) for example over defined periods or with respect to a reference value so that mains frequency-harmonic signals are detected by a defined value and the flame signal amplifier (40) is correspondingly controlled.

8 Claims, 5 Drawing Sheets

$U_{REF}$
$U_3$
$U_4$
$U_5$
$U_2$
$U_1$
1
2
3
4
5
6
7
8
9
10
11
12
13
14
17
18
19
40
m
T

FLAME MONITORING SYSTEM

BACKGROUND OF THE INVENTION

1. Field of the Invention

The invention concerns a flame monitoring system and a method of monitoring a flame.

2. Description of the Prior Art

For the purposes of monitoring oil, gas or coal dust flames, it is known to use flame monitoring systems and methods which utilise the fluctuations in intensity of the flame in the infra-red spectral range. The advantage of such systems is that they are suitable for all kinds of fuels and thus there is no need for fuel-specific monitoring modes in the case of multiple-fuel burners, for example involving the detection of UV-radiation in the case of gas and visible radiation in the case of heavy oil. Disadvantages with IR-monitoring however are that both the slow variations in intensity of a furnace wall involving afterglow phenomena—so-called striation or schlieren frequencies—and also the fast changes in light sources which are generally operated with mains ac voltage can simulate a flame. If artificial light happens to shine into the burner or combustion chamber during operation or also during the maintenance of burner systems, IR-monitoring would indicate the presence of a flame.

Filtration of striation or schlieren frequencies which are specified in various publications as being up to 3 Hz can be relatively easily implemented by means of high pass filters, in which case the flame frequencies produced by the combustion operation at above 10 Hz are not cut thereby. If however the harmonics of the mains frequency have to be suppressed by being filtered out, that makes matters more expensive and gives rise to more severe problems. This method necessarily also involves the loss of information from the flame, particularly if the mains frequency is subject to wide tolerances or if various rated frequency ranges have to be covered. The European equipment standard EN298 which is relevant for flame monitoring apparatuses also allows the option of shut-down of the flame sensor being effected by a suitable flame sensor fixing system if it is removed from the fixing. At any event the safeguard in relation to extraneous light is to be guaranteed even when consideration is given to primary and secondary faults, in accordance with EN298. With the last-mentioned method, it is thought that this is extremely difficult to achieve as proper operability, for example of a limit switch, can only be tested by actually removing the flame sensor from its fixing.

There is therefore a need to achieve immunity in relation to mains frequency-modulated extraneous light sources, by electronic means, either by circuits which are fail-safe in themselves or by cyclic testing, in the case of monitoring systems designed for continuous operation during operation of the burner.

EP 0 320 082 A1 describes a flame monitoring circuit in which just evaluation of the alternating light component of a flame is utilised as a measure for fail-safe flame detection. That structure however only affords a safeguard in relation to flame simulation as long as the safety-relevant ambient light referred to therein involves constant light. Light from generally ac voltage-operated extraneous light sources in contrast very definitely results in simulation of a flame and thus unsafe burner operation. In addition there is the danger that an internal component fault in the IC maintains actuation of the fuel valve in spite of the absence of a flame. For that reason alone use on burners in a continuous mode of operation is out of the question.

EP 0 334 027 A1 discloses a construction which is suitable in this respect, but the level of expenditure is disproportionately high as a result of the completely two-channel nature, and immunity in relation to mains-frequency alternating light signals is achieved with frequency-selective arrangements, the disadvantage of which, in terms of loss of flame signal information, has already been mentioned.

One way of obviating that deficiency is disclosed in EP 0 229 265 A1. In that case, mains frequency-harmonic signals are blocked with a high level of selectivity so that the information loss from the flame signal is kept very slight. The applicability to burners in a continuous mode of operation is doubtful however because an internal component fault, for example in the flip-flop, with flame simulation as a consequence, is not detected in operation, and immunity in relation to mains-frequency alternating light signals could at best be established in the burner stoppage condition.

SUMMARY OF THE INVENTION

The object of the present invention is to provide a flame monitoring system and a method of monitoring a flame, which has immunity in relation to mains frequency-harmonic input signals with a very low level of flame signal information loss and which is suitable for use in relation to burners in a continuous mode of operation.

In accordance with a first aspect of the invention, there is provided a flame monitoring system comprising:

- a flame sensor which converts the radiation emanating from a flame into a flame signal;
- a flame signal amplifier which converts the flame signal into an output signal; and
- a frequency-selective arrangement which detects the presence of mains frequency-harmonic signals in the flame signal;

wherein:

- the frequency-selective arrangement activates the flame signal amplifier when there are no mains frequency-harmonic signals in the flame signal; and
- the frequency-selective arrangement deactivates the flame signal amplifier when there is a flame signal with mains frequency-harmonic signals or no flame signal or a test signal.

In accordance with a second aspect of the invention, there is provided a method of monitoring a flame, comprising:

- converting radiation emanating from the flame into a flame signal which is converted into an output signal; and
- detecting the presence of mains frequency-harmonic signals in the flame signal by using a frequency-selective arrangement;

wherein:

- the flame signal is converted into an output signal when there are no mains frequency-harmonic signals in the flame signal; and
- the flame signal is converted into a zero signal where there is a flame signal with mains frequency-harmonic signals or no flame signal or a test signal.

The present invention attains the stated object in that a flame sensor firstly converts the radiation issuing from a flame into a flame signal which in turn is transformed into an output signal by a flame signal booster or amplifier. A frequency-selective arrangement which is arranged in parallel with the flame signal amplifier also receives the flame signal itself and checks it for the presence of period signals. If the absence of mains frequency-harmonic signals is detected by the frequency-selective arrangement the, flame signal amplifier is activated while upon the detection of mains frequency-harmonic signals or in absence of a flame signal, the flame signal amplifier is deactivated. There is also the possibility of overwriting the flame signal with a test signal so that the input of the flame signal amplifier and also the input of the frequency selective arrangement can be acted upon by the test signal itself so that failures within the flame monitoring circuit, for example the failure of individual components, can be detected.

In that respect, the frequency-selective arrangement has a frequency detector which detects the presence of non-periodic flame signals and suitably activates or deactivates the flame signal amplifier by way of suitable switching means. That can be embodied in various ways.

On the one hand it is possible for the flame signal firstly to be boosted and converted into a rectangular signal, in which respect any reference signal can be used for that conversion operation. That rectangular signal then serves as a control signal of a bipolar current or voltage source which in turn feeds an integrator so that the output signal of the integrator fluctuates about a constant mean value with periodic input signals from the frequency detector. In other words, the bipolar current or voltage source charges and discharges the integrator depending on the fluctuation width of the input or the flame signal so that the averaged integration value is approximately zero in the case of periodic input signals.

The frequency-selective arrangement also has a coupler or a switch which firstly establishes whether the output signal of the frequency detector, that is to say the integrated input signal, remains within a defined switching threshold about a given mean value in order then to actuate a switch which suitably activates or deactivates the flame signal booster. If the frequency detector establishes that there is a purely periodic signal, the above-indicated switching threshold ensures that residual fluctuations in the integrated signal around the constant mean value or slight deviations around the zero value remain disregarded, which, depending on the respective limit frequency of the integrator, can also be caused by purely mains frequency-harmonic input signals.

Another option is that the frequency detector integrates the input signal, that is to say for example the flame signal, over previously fixedly defined periods, and the frequency-selective arrangement uses the integrated output signal for the actuation of a switch which in turn activates or deactivates the flame signal amplifier. By virtue of integration over those defined periods, it is possible to effect very tight, that is to say narrow-band filtering of discrete frequencies which are usually multiples of the mains frequencies so that here extraneous light components which follow the ac voltage of the mains frequency are sharply filtered out so that all other frequencies, that is to say in particular flame signals, can be detected in a virtually loss-free manner. In that respect it is appropriate for the frequency detector to be reset into its initial condition after each integration operation over one of the defined periods, otherwise drifting-away of the integrator output voltage could result in flame simulation, which in the test would be recognised as a component fault.

In that respect the flame signal is overwritable with a mains frequency-harmonic test signal so that the frequency detector then evaluates the test signal which permits checking of the circuit as such and detects the failure of individual components.

The frequency detector activates the switch in such a way that, in the case of the absence of a mains frequency-harmonic flame signal, the flame signal amplifier supplies a valid output signal while, upon the detection of mains frequency-harmonic input signals, at the frequency detector, the flame signal amplifier is deactivated so that a valid signal is not delivered at the output of the flame signal amplifier.

The mains frequency-harmonic test signal is advantageously applied at regular intervals of time in order always to have certainty about satisfactory functioning of the flame monitoring circuit.

BRIEF DESCRIPTION OF THE DRAWINGS

Preferred embodiments of the invention are described in greater detail hereinafter with reference to the drawings, in which.

DESCRIPTION OF THE PREFERRED EMBODIMENTS

Figure 1:
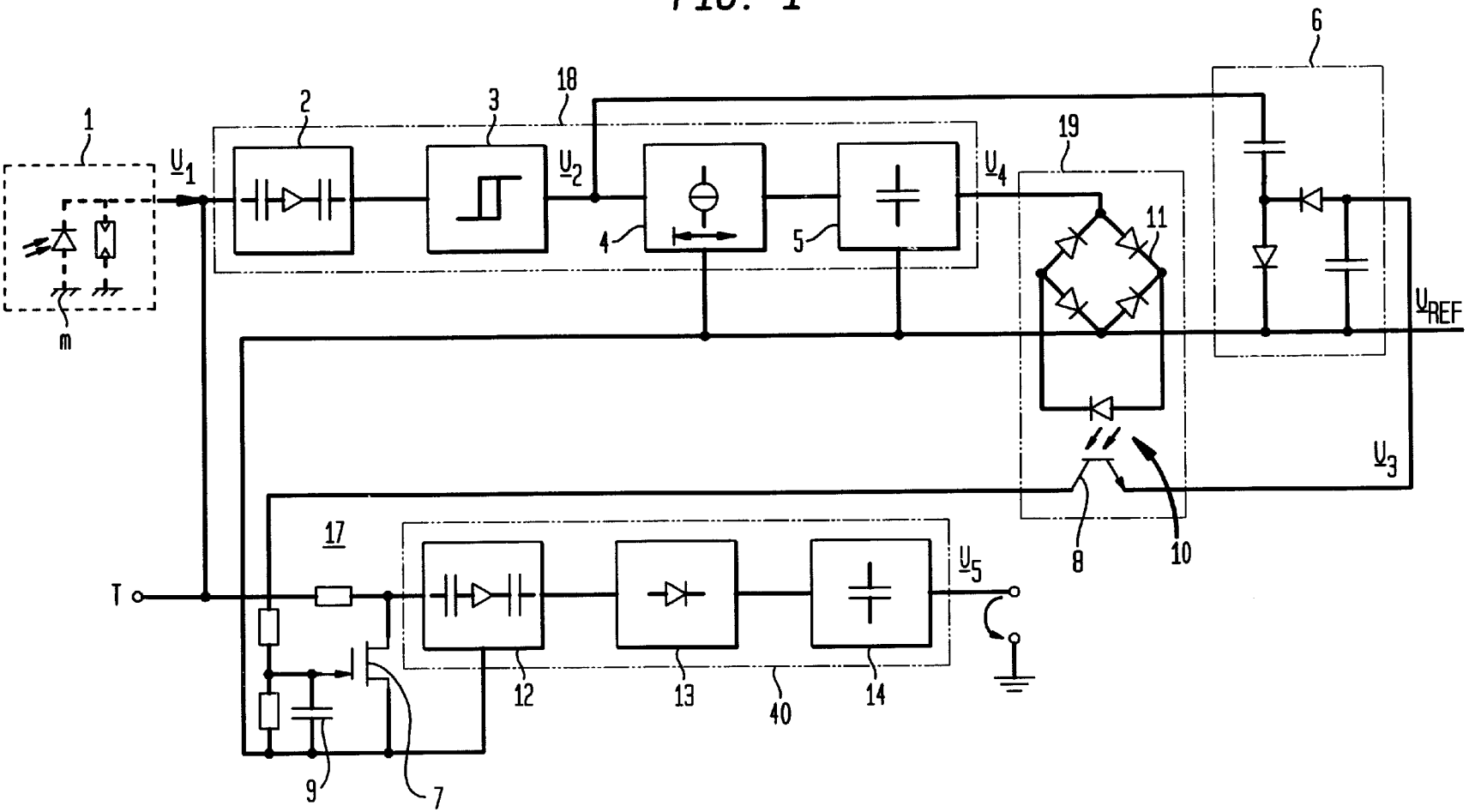
FIG. 1 shows a flame monitoring system with suitable switching elements.

FIG. 1 shows a flame monitoring system. The flame radiation which is picked up by a sensor 1 and converted into an electrical signal, the signal voltage $U_1$, is firstly amplified or boosted in a first input amplifier 2 with a high pass characteristic and fed to the input of a Schmitt trigger 3. The signal voltage $U_1$ is related to a ground m. Now, the signal voltage $U_2$ at the output of the Schmitt trigger 3 is used firstly to operate a bipolar current source 4 which positively or negatively charges a first integrator 5 with respect to a reference voltage $U_{Ref}$. The polarity and duration of the respective charging cycles are dependent on the state of the output of the Schmitt trigger 3 and thus directly dependent on the signal voltage $U_1$ of the sensor 1. The integrator 5 has a low pass characteristic, wherein the limit frequency of the low pass is typically about 80 Hz.

The signal voltage $U_2$ at the output of the Schmitt trigger 3 is secondly processed by means of a circuit 6 for control of a n-channel JFET 7 (junction field effect transistor) which operates as a switch. The circuit 6 is in the form of a charging pump which comprises two capacitors and two diodes and which transforms the alternating output signal $U_2$ of the Schmitt trigger 3 into a dc voltage signal $U_3$ of negative polarity. The dc voltage signal $U_3$ is fed to the control input of the JFET 7 by way of a second switch 8 controlled by the output signal $U_4$ of the integrator 5. The control input of the JFET 7 is also connected to the reference voltage $U_{Ref}$ by way of a capacitor 9, for smoothing the control voltage. In the illustrated example the second switch 8 is in the form of the light-receiving side of an optocoupler 10 whose light-transmitting side is fed the signal voltage $U_4$ at the output of the integrator 5 by way of a rectifier 11.

The rectifier 11 and the optocoupler 10 disposed on the output side thereof represent a load for the integrator 5. The integrator 5 is now charged and discharged at irregular intervals by the current source 4 in accordance with the state of the output of the Schmitt trigger 3. On the other hand, the integrator 5 is loaded if the magnitude of the signal voltage $U_2$ at its output is above the threshold value of the optocoupler 10. In the case of frequencies of the signal voltage $U_1$, which are below the limit frequency of the low pass of the integrator 5, the charging current supplied by the current source 4, for the integrator 5, is markedly greater than the discharging current, as a result of the loading due to the rectifier 11 and the optocoupler 10 so that the integrator 5 can be charged both to a comparatively high positive and negative potential. In the case of frequencies of the signal voltage $U_1$, which are above the limit frequency of the low pass of the integrator 5, the discharging current, as a result of the loading due to the rectifier 11 and the optocoupler 10, is markedly greater than the charging current supplied by the current source 4 so that the signal voltage $U_2$ at the output of the integrator 5 remains below the switching threshold of the optocoupler 10.

The signal voltage $U_1$ is now secondly fed to a second input amplifier 12 with a high pass characteristic, rectified by means of a second rectifier 13 and fed to a second integrator 14. When the JFET 7 is in the non-conducting condition, then the signal voltage $U_1$ is amplified by the second input amplifier 12 and the voltage $U_5$ at the output of the second integrator 14 is of a value which is different from the potential of the ground m. If in contrast the JFET 7 is in the conducting state then the signal voltage $U_1$ at the input of the amplifier 12 becomes ineffective so that the voltage $U_5$ at the output of the integrator 14 assumes the potential of the ground m.

Figure 2:
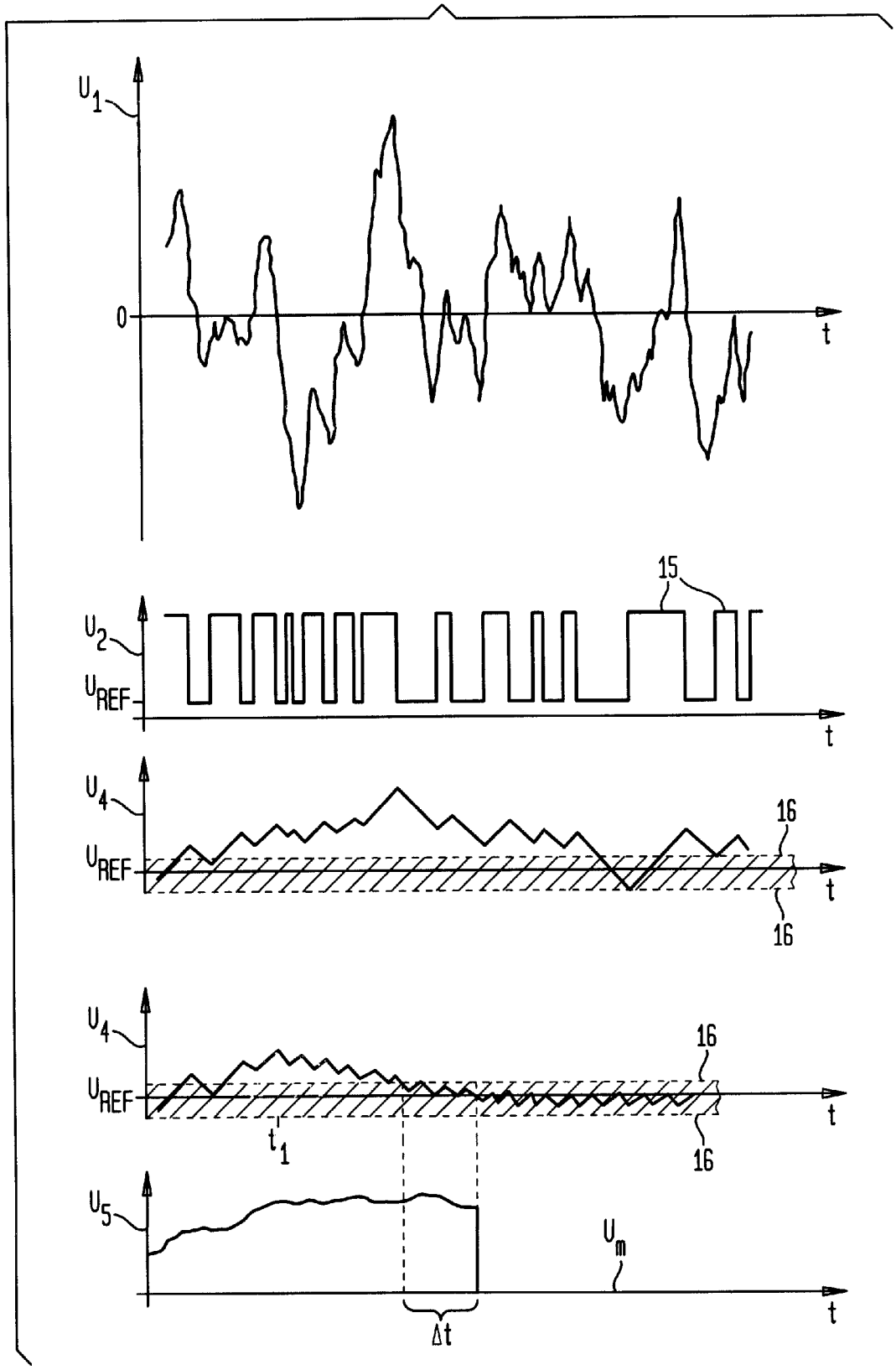
FIG. 2 shows the signal configurations of the flame monitoring system shown in FIG. 1.

FIG. 2 shows the voltage signals $U_1$, $U_2$ and $U_4$ for the situation where only radiation emanating from the flame impinges on the sensor 1. Pulses 15 of different lengths occur at the output of the Schmitt trigger 3. As long as a pulse 15 is present the integrator 5 is charged up by the current source 4, while the integrator 5 is discharged in the intervals between the pulses 15. In that respect in accordance with the foregoing description the signal voltage $U_2$ is usually above the switching threshold 16 of the optocoupler 10. As can be seen from the Figure, however, the optocoupler 10 is switched on and off at irregular intervals of time. By virtue of the smoothing of the output signal of the optocoupler 10 by the capacitor 9, however, the JFET remains in the non-conducting state so that the flame signal $U_1$ goes to the second input amplifier 12 and the voltage $U_5$ at the output of the second integrator 14 is of a value which denotes "flame present".

If the sensor 1 (FIG. 1) is released from its holder and placed beside the burner, and then for example the light which emanates from a neon tube and has a basic frequency of about 100 Hz impinges thereon, then at the output of the Schmitt trigger 3 there is a signal voltage $U_2$ which comprises a regular sequence of pulses 15 whose pulse duty factor is 1. The pulses 15 charge and discharge the integrator 5 by means of the current source 4 during respectively equal-length times so that the signal voltage $U_4$ at the output of the integrator 5 is after just a short time a triangular voltage whose peak values are below the switching threshold of the optocoupler 10 because of the low pass characteristic of the integrator 5. The optocoupler 10 then remains permanently switched off and the JFET 7 becomes conducting. Consequently the flame sensor is no longer amplified by the second input amplifier 12 and the voltage $U_5$ at the output of the second integrator 14 assumes the value of the ground m, which denotes "flame absent".

FIG. 2 also shows the configuration of the signal voltage $U_4$ for the situation where the sensor 1 was released from its holder at the time $t_1$ (FIG. 1). The switching thresholds 16 of the optocoupler 10 are also illustrated. The signal voltage $U_4$ which randomly has a high value at the time $t_1$ so that the JFET is non-conducting gradually falls because of the low pass characteristic of the integrator 5 and ultimately can no longer actuate the optocoupler 10.

FIG. 1 also shows a control input, by way of which a test signal T can be superimposed on the signal voltage $U_1$. Such a test signal T is for example a 100 Hz signal which simulates a light source operated with alternating current. If the test signal T is applied from the time $t_1$ then the output signal $U_4$ of the integrator 5, by virtue of the attenuation effect of the coupler 19, that is to say the rectifier 11 and the optocoupler 10, goes towards the reference voltage $U_{Ref}$, in which case after falling below the threshold value 16 and after expiry of the period of time $\Delta_t$, the output voltage $U_5$ at the output of the flame sensor amplifier 40 assumes the value of ground m. Accordingly, in this case, as shown in FIG. 2, there is an output signal which, in spite of the sensor being strongly illuminated with artificial light, indicates "flame absent".

Often however there is a wish for an output signal which not only signals the presence of a flame but also represents a measurement in respect of the strength of the flame radiation detected by the sensor. For that reason the actual flame sensor amplifier 40 is constructed in the form of a purely analog processing channel with the blocks 12, 13 and 14.

The blocks 18, 19 and blocks 6 and 17 here have to perform two different tasks:

1. Signalling whether there is a valid flame signal $U_1$, that is to say whether the frequency of the input signal and thus the on/off ratio of the Schmitt trigger 3 is continually altering; and 2. Indicating that the analog value $U_5$ at the output of the integrator 14 is becoming zero when the flame sensor 1 supplies a signal at a constant frequency or no longer supplies a signal, in which case that indication must be afforded as a consequence of the application of a test voltage $U_T$.

The configuration shown in FIG. 1 is not only limited to blocking given frequencies, but in principle forms the mean value 0 at any constant frequency at the integrator 5. Depending on the respective frequency of the input signal $U_1$ and depending on the respective time constant of the integrator 5, however, the instantaneous voltage reaches values of greater or lesser magnitude so that periodic pulsed actuation of the coupler 19 is possible under given system conditions. The recommendation here is for the integrator 5 to be supplemented with a series resistor to form a simple RC low pass member and for the current source 4 to be in the form of a voltage source, for example a bipolar voltage source, so that, for Schmitt trigger pulses with a pulse duty factor of 1, there is a damping or attenuation effect which increases only moderately above the limit frequency at any event at 6 decibels per octave. The more however the pulse duty factor also deviates from 1 at the higher frequencies, the less is the action of that damping effect. Depending on the respective configuration in respect of time of the flame signal $U_1$, there occur at the capacitor of the integrator 5 voltages which fluctuate more or less frequently in terms of amplitude and polarity. Even if it is assumed that the radiation frequency of mains-operated light sources is double the mains frequency, that is to say for example 100 Hz, the limit frequency of the above-mentioned simple low pass member must be set so low that a distinction can be drawn with sufficient accuracy between the useful signal of the flame and an interference signal, of for example 100 Hz.

In order in this case with the same signal-to-noise ratio to achieve a greater bandwidth for the useful signal, it is advantageous for example to interpose a higher-order low pass member at the output of the input amplifier 2.

In order however to obtain the bandwidth for the flame signal which is independent of the mains frequency-harmonic noise signals, an infinitely narrow-band block is required for those interference noise frequencies.

Figure 3:
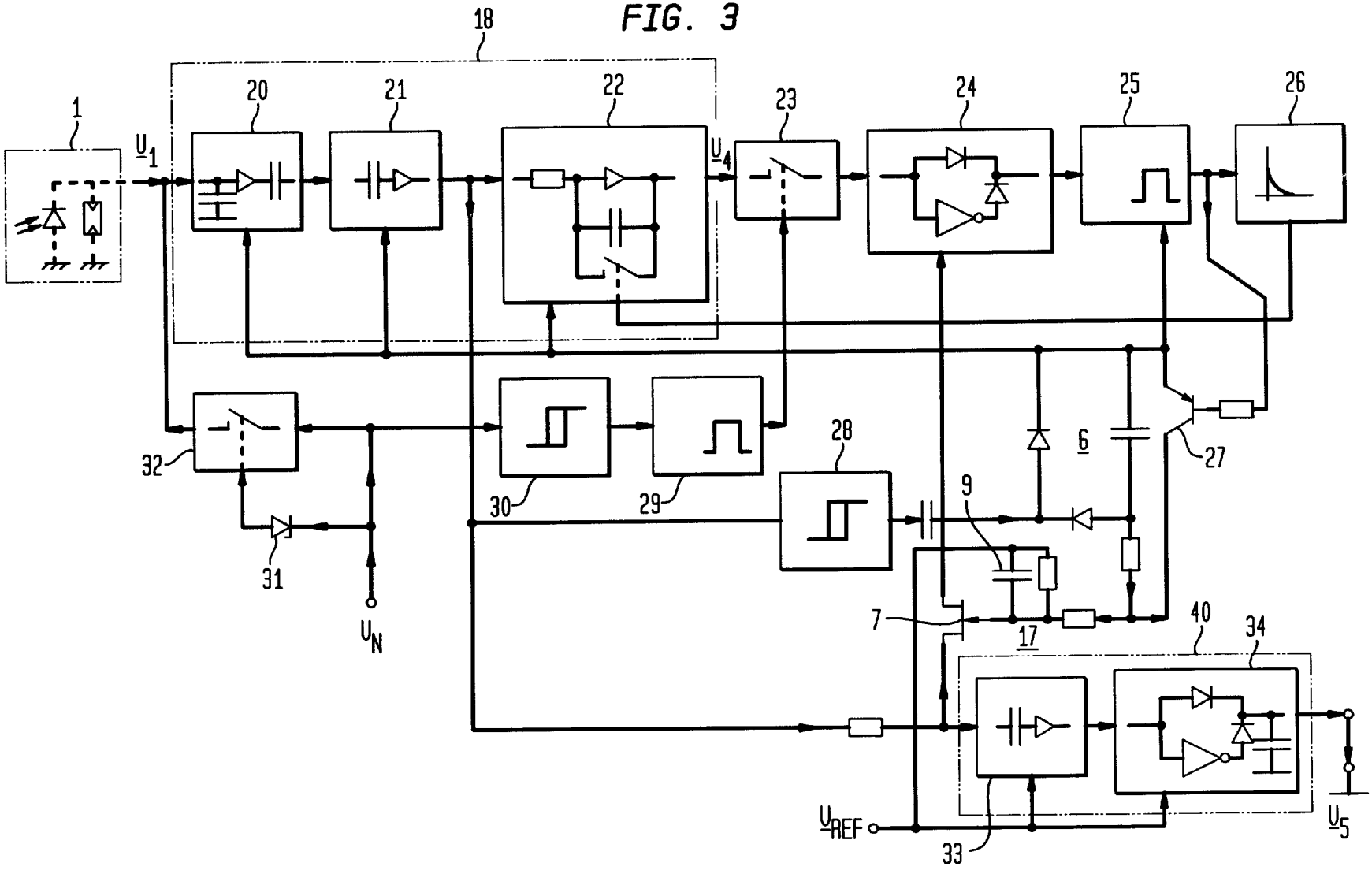
FIG. 3 shows another flame monitoring system with suitable switching elements.

FIG. 3 shows a solution which is especially designed for blocking defined harmonic mains frequencies, that is to say for example 50 Hz, 100 Hz, 150 Hz and so forth. Here, the mean value is formed afresh over each mains period and read out in such a way that mains frequency-harmonic sensor signals always result in the read-out value zero while signals at a frequency differing therefrom give values whose magnitudes are different from zero in order thus to provide for detecting a valid flame signal $U_1$. With this principle, the integration time is directly dependent on the current mains frequency, thereby permitting a sharp distinction to be drawn between useful and noise signals.

The input amplifier 20 with a low pass characteristic serves for pre-amplification of the sensor signal $U_1$ with at the same time damping of high-frequency interference voltages. It is followed by a further amplifier 21 with a high pass characteristic, in which as mentioned above striation or schlieren frequencies are damped.

The output signal of this amplifier 21 is subjected to further processing by way of three different procedures for various purposes. Integration over a respective mains period is effected in the mean value-forming device 22. The mean value-forming device or integrator 22 is reset to zero by means of the switch illustrated in 22 after each integration interval. Immediately prior to that RESET the current value of the integrator is read out by closing of the switch 23 and switched by way of the full-wave rectifier 24 in the form of a trigger pulse to the input of the monoflop 25. The control pulse for the RESET switch of the integrator or mean value-forming device 22 is obtained with the differentiator 26 from the leading edge of the monoflop pulse.

A trigger pulse for the monoflop 29 is then produced in the Schmitt trigger 30 from the mains hum voltage $\Delta U$ for control of the read-out switch 23, and that trigger pulse then in turn actuates the read-out switch 23 in mains-synchronous relationship. The dependency of the RESET pulse for the integrator 22 on the leading edge of the monoflop 25—and not for example directly the control pulse for the read-out switch—is intended to ensure that the content of the integrator 22 is always read out before it is erased by the RESET pulse.

Similarly to the principle shown in FIG. 1, in this case also the output signal $U_4$ of the integrator 22 is used indirectly for releasing the sensor signal $U_1$—which is pre-amplified in this case—for further processing.

For that purpose firstly the pre-amplified sensor signal $U_1$ is fed to the Schmitt trigger 28 whose output pulses are utilised to produce a negative voltage by means of the charging pump 6. As in FIG. 1, the negative voltage serves to switch off the self-conducting JFET 7, whereby the input of the active filter stage 33 is enabled for the pre-amplified sensor signal $U_1$. That stage again has a high pass characteristic in order further to damp the schlieren frequency signals. In the subsequent full-wave rectifier 33 with integration capacitor, the analog output voltage $U_5$ is obtained from the pre-amplified sensor signal $U_1$.

Figure 4:
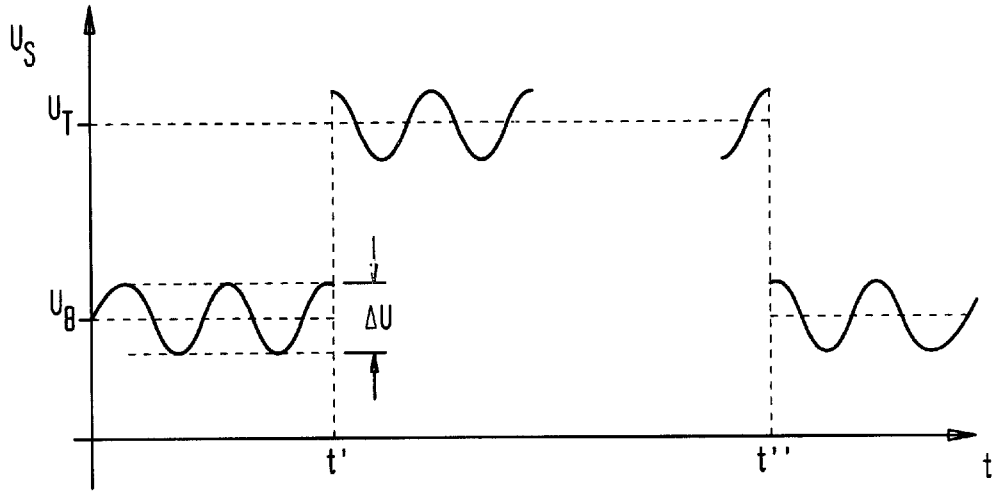
FIG. 4 shows a test signal of the flame monitoring system shown in FIG. 3.

For the test in respect of switching off the output signal $U_5$ when mains frequency-harmonic sensor signals $U_1$ occur, the threshold of the Zener diode 31 is exceeded by raising the mean value of the amplifier feed voltage $U_5$ from the operating value $U_B$ to the test value $U_T$ and the test switch 32 is closed, whereby the mains hum voltage $\Delta U$ which is superimposed on the feed voltage $U_T$ is superimposed on the sensor signal $U_1$ and thus a mains-frequency noise signal is coupled in (see FIG. 4). Overwriting of the sensor signal by the mains hum voltage, which is forced in that way, has the result that the values averaged over each mains period at the integrator 22 become zero so that finally the switch 17, that is to say the JFET 7, becomes conducting and the output signal $U_5$ must also become zero.

FIG. 4 shows switching-over of the feed voltage $U_S$ from operation $U_B$ to test $U_T$ and vice-versa. This switching-over procedure can also be controlled by a microprocessor system. Fault detection is effected on the basis of the same principle as described for FIG. 1.

The amplifier feed voltage $U_S$ is equal to $U_B$ plus $\Delta U$. The phases operation and test are shown in FIG. 4 in such a way that the test voltage is applied between the times t' and t".

Figure 5:
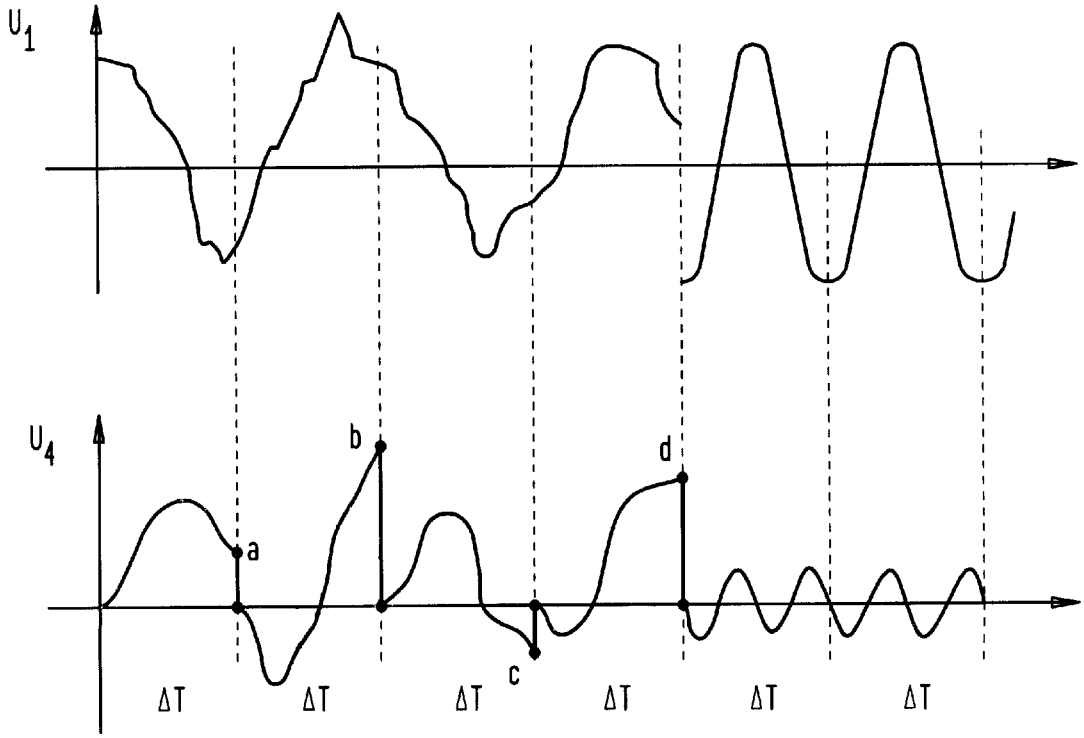
FIG. 5 shows the signal configurations of the flame monitoring system shown in FIG. 3.

FIG. 5 shows the contents of the integrator or mean value-forming device 22. With various sensor signals $U_1$, respectively different output signals $U_4$ of different values a, b, c and d are ready for reading-out at the output of the integrator 22. It can be seen from the configuration of the integrator voltage $U_4$ that the zero point-symmetrical noise signal must always supply the result zero if integration is effected over constant periods $\Delta T$. These are advantageously mains periods or multiples of the corresponding mains period. In that respect, the time at which the integration interval begins is immaterial. The time from the beginning of read-out to the end of resetting, that is to say to the beginning of the next integration interval, can be kept so short in relation to the mains period duration $\Delta T$, that is to say the interval itself, that the "measurement error" is negligible in spite of integration in each of the successive mains periods.

Figure 6:
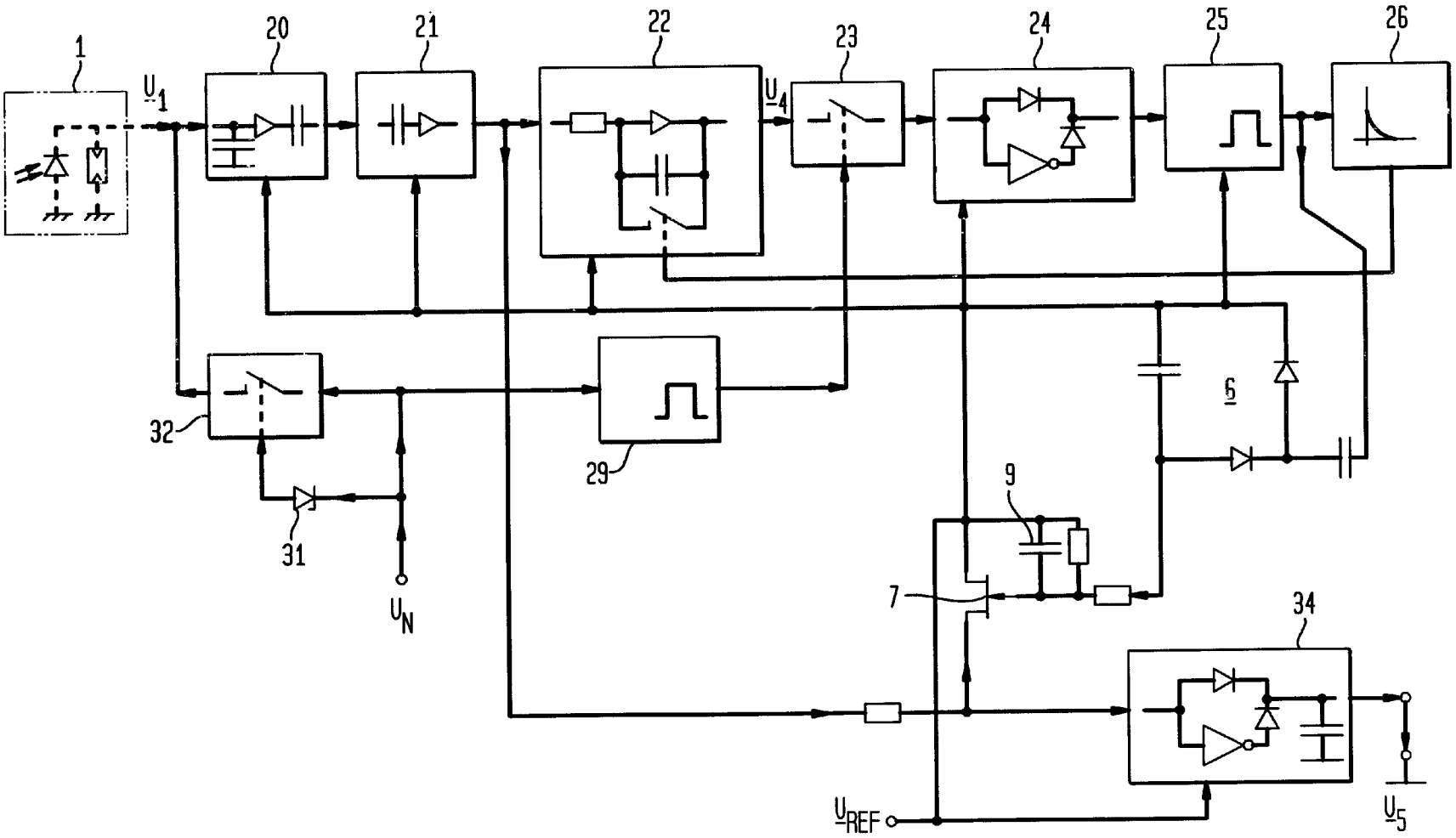
FIG. 6 shows a simplified version of the flame monitoring system illustrated in FIG. 3.

The circuit shown in FIG. 3 may also be the subject of variations. FIG. 6 shows by way of example such a variant of the circuit shown in FIG. 3. Thus it is possible for example also to use the output signal of the Schmitt trigger 30 for operation of the charging pump 6, in order to save on the Schmitt trigger 28. Besides the saving in terms of components, this alternative configuration would have the advantage of more uniform and thus more reliable gate voltage generation for the self-conducting JFET 7 as a result of a constant pump frequency. It will be appreciated however that this would then lose a property which is available now, which also has a certain advantage, namely that the charging pump with its high pass characteristic affords an additional safeguard against the detection of schlieren or striation signals as described above, if it is dependent on the useful signal as in FIG. 3.

It can also be envisaged that the active filter stage 33 can be omitted if damping of the striation or schlieren frequencies in the high pass amplifier 21 is already sufficient to avoid flame simulation.

The Schmitt trigger 30 is also not necessary because the monoflop 29 can be operated directly by the mains hum voltage $\Delta U$.

A further alternative configuration which saves on the Schmitt trigger 28 would involve operating the charging pump 6 from the monoflop 25. As a consequence thereof the transistor 27 could be omitted so that the discharging time constant of the charging pump 6 can be so small that the test can be implemented in the time available for same.

I claim:

1. A flame monitoring system comprising;

a flame sensor which converts the radiation emanating from a flame into a flame signal;

a flame signal amplifier which converts the flame signal into an output signal; and a frequency-selective arrangement which detects the presence of mains frequency-harmonic signals in the flame signal, wherein the frequency-selective arrangement has a frequency detector which detects the presence of mains frequency-harmonic signals in the flame signal and integrates the flame signal over defined periods and the frequency-selective arrangement uses that integrated output signal for the actuation of a switch which activates or deactivates the flame signal amplifier; and wherein the frequency-selective arrangement activates the flame signal amplifier when there are no mains frequency-harmonic signals in the flame signal and the frequency-selective arrangement deactivates the flame signal amplifier when there are mains frequency-harmonic signals in the flame signal or no flame signal or a test signal.

2. A flame monitoring system according to claim 1, wherein the frequency detector converts the flame signal into a rectangular signal and uses the rectangular signal as a control signal of a bipolar current/voltage source for feeding an integrator so that the output signal of the integrator fluctuates about a constant mean value when mains frequency-harmonic signals are in the flame signal.

3. A flame monitoring system according to claim 2, wherein the frequency-selective arrangement has a coupler which, when the output signal of the frequency detector remains within a defined switching threshold around the constant mean value, activates the switch which deactivates the flame signal amplifier.

4. A flame monitoring system according to claim 1, wherein the frequency detector is resettable to its initial state after each integration over one of the defined periods.

5. A flame monitoring system according to claim 1, wherein the defined periods are multiples of the mains periods.

6. A flame monitoring system according to claim 1, wherein the flame signal is overwritable with a periodic test signal and the frequency detector evaluates the test signal.

7. A method for monitoring a flame comprising:

converting radiation emanating from the flame into a flame signal which is converted into an output signal, and detecting the presence of mains frequency-harmonic signals in the flame signal by using a frequency-selective arrangement, wherein the mains-frequency harmonic signals in the flame signal are detected by means of integration of the flame signal over defined periods and if an integrated flame signal is zero or remains within a defined switching threshold value the flame signal is converted into a zero signal, or the flame signal is converted into a zero signal when there is no flame signal or a test signal, and the flame signal is converted into an output signal when there are no mains frequency-harmonic signals in the flame signal.

8. A method according to claim 7, wherein a periodic test signal is applied in regular time intervals and an occurrence of the zero signal is checked.

* * * * *